US005495630A

United States Patent [19]

Estein et al.

[11] Patent Number: 5,495,630

[45] Date of Patent: Mar. 5, 1996

[54] DART TOOL

[76] Inventors: Kevin M. Estein, 4152 W. Tierra Buena, Phoenix, Ariz. 85023; Michael F. Nauroth, 6105 W. Gelding Dr., Glendale, Ariz. 85306

[21] Appl. No.: 178,059

[22] Filed: Jan. 5, 1994

[51] Int. Cl.[6] ..... B25B 13/00

[52] U.S. Cl. ..... 7/138; 7/169

[58] Field of Search ..... 7/138, 169, 170; 81/176.1, 176.15

[56] References Cited

U.S. PATENT DOCUMENTS

| | | | |
|---|---|---|---|
| 3,629,883 | 12/1971 | Norman | 7/170 |
| 4,974,273 | 12/1990 | Buttermore et al. | 7/138 X |
| 5,205,193 | 4/1993 | Wield | 81/176.15 |

*Primary Examiner*—James G. Smith

*Attorney, Agent, or Firm*—Martin L. Stoneman

[57] ABSTRACT

A dart tool useful in tournament darts and other games using thrown darts. This unitary dart tool efficiently combines many useful elements and functions, including: extracting a broken dart tip from a dart target by providing, on a thin nub, a tapered slot for grabbing such broken dart; adjusting a dart assembly having a flight shaft, a barrel, and a dart tip; tightening or loosening a threaded connection between a dart tip and a dart barrel by providing a slot for holding the opposed flat portions of a dart tip; tightening or loosening a threaded connection between a flight shaft and a dart barrel by providing a protuberance, which comprises part of the described slot, for holding the hole in the flight shaft; loosening a flight lock of the dart by providing a safe recessed wedge therefor; tightening a flight lock by providing a cylindrical hole therefor; and also permitting keychain attachment and bottle-opening, and providing advertising areas.

15 Claims, 2 Drawing Sheets

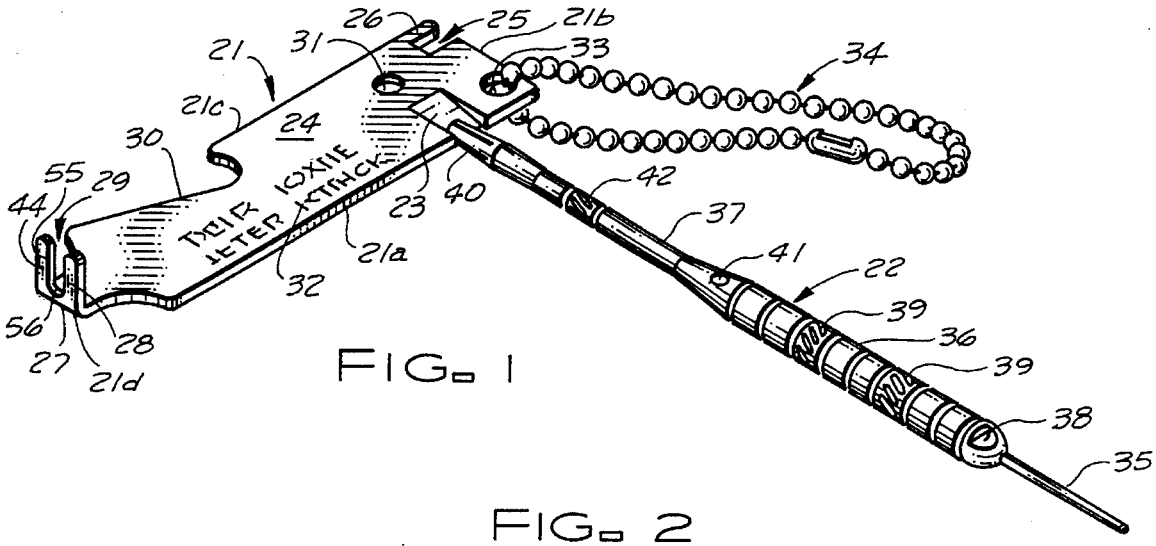
FIG. 1
FIG. 2
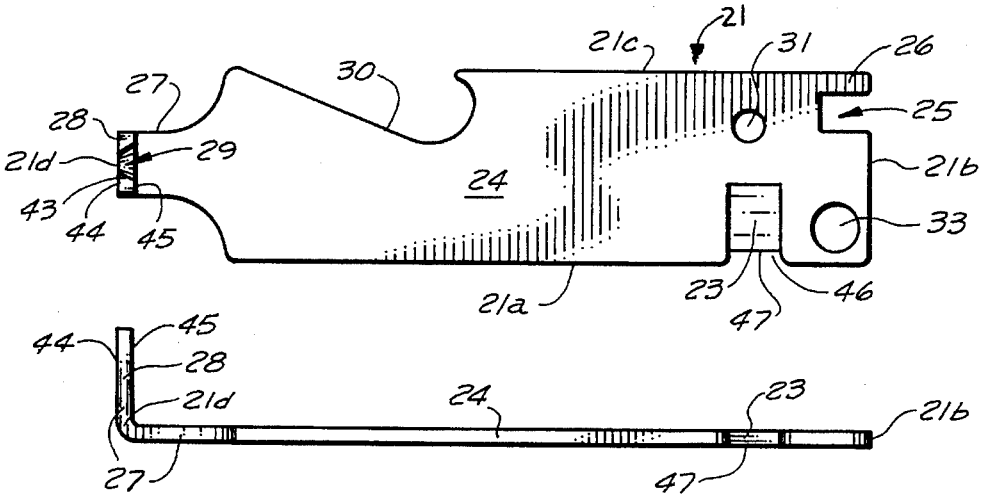
FIG. 3
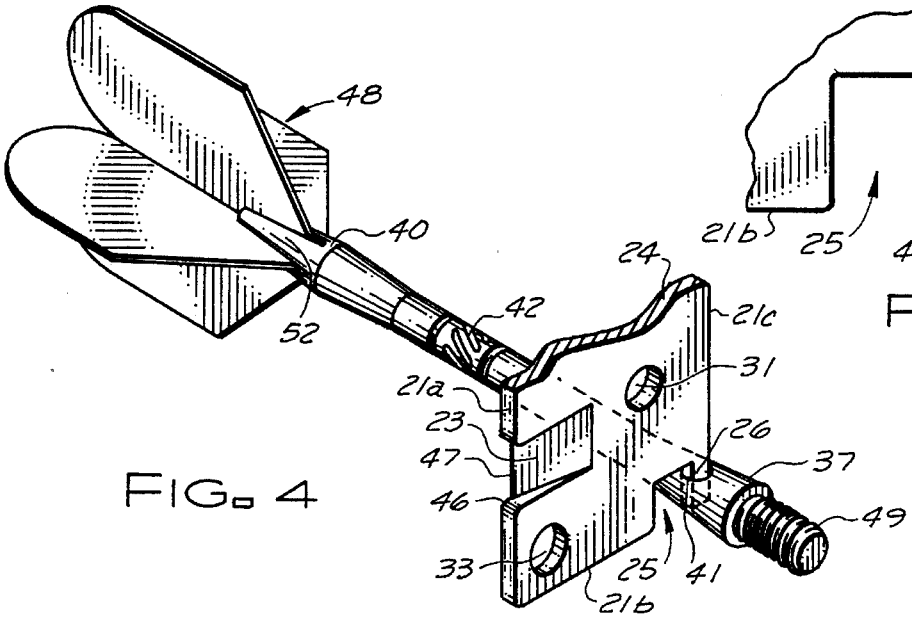
FIG. 4
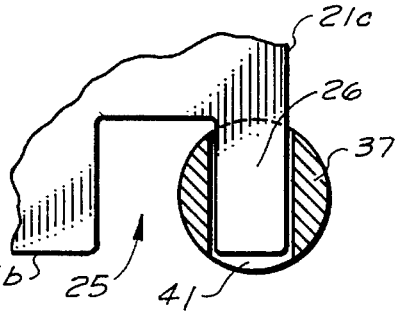
FIG. 5

DART TOOL

BACKGROUND OF THE INVENTION

1. Field of the Invention

This invention relates generally to a novel tool useful in tournament darts and other games using thrown darts. More specifically, this invention provides, in one tool, efficiently combined, a dart tool assisting many useful elements and functions, e.g., extracting a broken dart tip from a dart target; adjusting a dart assembly having a flight shaft, a barrel, and a dart tip; tightening or loosening a threaded connection between a dart tip and a dart barrel, tightening or loosening a threaded connection between a flight shaft and a dart barrel, loosening a flight lock of the dart, tightening the flight lock, even efficiently also combining useful elements, functions and abilities like keychain attachment, bottle-opening, and providing advertising areas.

2. Description of the Prior Art

Tournament darts and other games using thrown darts provide competition, recreation, and enjoyment for countless players. A typical dart used in such games has four main parts aligned along a longitudinal axis of the dart. A pointed dart tip, often made of a hard but bendable plastic, is affixed to a barrel, usually by threaded connection, so that the dart tip extends forwardly from the front end of the barrel. A flight shaft extends rearwardly from the rear end of the barrel and the flight shaft is connected to the barrel at a threaded connection. There is a flight lock at the rear end of the flight shaft. A cross-shaped flight is mounted in the flight lock. Typically, the flight lock has a conical portion with a smaller end rearward and a larger end forward and with four bendable prongs defining a cross-shaped slot opening at the smaller end. The cross-shaped flight is pressed into the cross-shaped slot, in which the flight is retained by the prongs. Typically, the flight is made of lightweight, reinforced fabric, foil or polymeric film. Thus, the flight is a wearable part, which needs to be occasionally replaced.

Also typically, the flight shaft has within it a transverse hole, into which, for example, a pin is insertable. This pin and flight shaft may then be held against rotation while the barrel is rotated about the axis of the dart, or vice versa, to tighten or loosen the threaded connection between the flight shaft and the barrel. It is a known practice to use the tip of a second dart as the pin. Such a practice is not recommended, however, since it creates a risk of bending the tip of the second dart. Also typically, a knife blade or similar tool is used to open the flight lock. Such tool is used to spread the bendable prongs sufficiently for the cross-shaped flight to be easily pressed into the cross-shaped slot yet retained securely therein by the bendable prongs. If the flight lock has been opened too far, the cross-shaped flight is not retained securely in the cross-shaped slot. It then is necessary to press the bendable prongs so as to close the flight lock. However, it is difficult to do so without twisting the bendable prongs, as may occur if a pair of pliers or similar tool is used.

Also typically, The shaft of the dart tip contains, exposed near its threaded connection to the barrel, opposed flat portions to assist in holding the dart tip while rotating the barrel along its axis, or vice versa, to tighten or loosen the threaded connection between the barrel and the dart tip. Although these opposed flat portions may commonly assist gripping with hand or pliers, it is difficult to grasp and hold the small dimensions of a commonly smooth and slippery dart tip without injury to the dart tip.

Also typically, a dart tip frequently breaks when thrown into a dart target, and the broken dart tip portion embedded in the target is difficult to remove in that it is difficult to grasp the broken dart tip to pull it out and the attempt to do so using, for example, a pocket knife, may easily result in injury to the dart target and/or to the knife wielder.

Prior attempts to design a dart tool to assist the user in overcoming the above-mentioned problems have resulted in operational insufficiencies, and new problems, and multiplicities of tools and parts, and inefficiencies of cost and quality. For example, recent attempts at replacing the pocket knife function of loosening the flight locks of a dart have not eliminated the dangers inherent in the exposed edges of such knives, and there has been no attention at all paid by dart tool designers to most of the other problems above mentioned.

Thus, for a considerable time period there has existed a need, to which the present invention is addressed, for a unitary, pocket-sized dart tool having multiple elements and functions for addressing the above-mentioned and other problems in an efficient, safe, cost-effective, combinatorial, creative, and operational manner.

OBJECTS OF THE INVENTION

Accordingly, it is an object of this invention to provide an improved dart tool means for use by players in the game of darts.

It is a further object of this invention to provide an efficient unitary dart tool which overcomes the problems presented by the prior art.

It is a further object of this invention to provide, in a unitary dart tool, in creative combination, multiple elements and functions which together overcome the problems presented by the prior art.

It is a further object of this invention to provide a dart tool for extracting a broken dart tip from a dart target.

Another object of this invention is to provide a dart tool for adjusting a dart assembly of the type including a flight shaft, a barrel, and a dart tip. Yet another object of this invention is to provide a dart tool for tightening or loosening a threaded connection between a dart tip and a dart barrel. Still another object is to provide a dart tool for tightening or loosening a threaded connection between a flight shaft and a dart barrel. An additional object is to provide a dart tool for loosening a flight lock of the dart. Yet an additional object is to provide a dart tool for tightening the flight lock. Other objects are to provide in a dart tool abilities to attach a keychain, open a bottle, and/or provide advertising areas.

SUMMARY OF THE INVENTION

According to the foregoing objectives, this invention describes an improved dart tool which is unitary in construction and yet provides, in combination, elements and functions fulfilling all of said objectives.

Further, this invention provides a dart tool suitable for adjusting a dart assembly having a flight shaft, a barrel and a dart tip, comprising, in combination, elongated, planar handle means and, recessed in such handle means and adjacent a first end of such handle means, wedge means for opening a flight lock in a dart. The instant dart tool may further include, situate in such handle means adjacent such first end, slot means, and, in line with an edge of such handle means, a planar protuberance comprising a first side of such slot means. And such dart tool is further provided wherein such wedge means comprises a single plane inclined with respect to such handle means. And such dart tool is further provided wherein such wedge means is located along a side of such handle means.

The instant dart tool, suitable for extracting a broken dart tip from a dart target, may further include thin nub means comprising the terminus at the other (second) end of such handle means, an outward portion of such nub means being situate at about 90 degrees from the plane of such handle means, and, in such outward portion, tapered slot means for grabbing a such broken dart tip. And such dart tool is further provided wherein such tapered slot means widens toward the handle-means side of such outward portion of such nub means. And such dart tool is further provided wherein such tapered slot means is wider than a such broken dart tip at the open end of such tapered slot means and narrower than a such broken dart tip at the closed end of such tapered slot means.

And such dart tool may further include, in such handle means along the edge of such handle means with which said planar protuberance is in line, bottle opener means. And such dart tool is further provided wherein such wedge means is located along an edge of such handle means opposed to such edge with which such planar protuberance is in line, and wherein such wedge means comprises a single plane inclined with respect to such handle means, and wherein such planar protuberance is constructed and arranged for holding such flight shaft for rotatively disconnecting from such barrel, and wherein such handle means is constructed and arranged for holding advertising indicia.

Further, this invention provides a dart tool suitable for extracting a broken dart tip from a dart target, comprising, in combination, elongated, planar handle means, thin nub means comprising the terminus at a first end of such handle means, an outward portion of such nub means being situate at about 90 degrees from the plane of such handle, and, in said outward portion, tapered slot means for grabbing a such broken dart tip. Such dart tool may further include, situate in such handle means adjacent the second end of such handle means, slot means, and, in line with an edge of such handle means, a planar protuberance comprising a first side of such slot means. And such dart tool is further provided wherein such tapered slot means widens toward the handle-means side of such outward portion of said nub means. And such dart tool is further provided wherein such tapered slot means is wider than a such broken dart tip at the open end of such tapered slot means and narrower than a such broken dart tip at the closed end of such tapered slot means.

Further, this invention provides a dart tool suitable for adjusting a dart assembly having a flight shaft, a barrel and a dart tip, comprising, in combination, elongated, planar handle means, situate in such handle means adjacent a first end of such handle means, slot means, and, in line with an edge of such handle means, a planar protuberance comprising a first side of such slot means, wherein such slot means is constructed and arranged for holding such dart tip for rotatively disconnecting from such barrel. And such dart tool is further provided wherein such planar protuberance is constructed and arranged for holding such flight shaft for rotatively disconnecting from said barrel.

BRIEF DESCRIPTION OF THE DRAWINGS

FIG. 1 is a pictorial illustration of a preferred embodiment of the dart tool of the present invention and a typical dart assembly, and further illustrating the use of the dart tool wedge means to loosen the flight lock of the dart assembly.

FIG. 2 is a top view of the preferred embodiment of the dart tool of the present invention.

FIG. 3 is a front view of the preferred embodiment of the dart tool of the present invention.

FIG. 4 is a pictorial view of a flight shaft and flight of a typical dart, illustrating the use of the preferred embodiment of the dart tool of the present invention to rotatively restrict the flight shaft.

FIG. 5 is a partial sectional view through the axis of the flight shaft of FIG. 4 and in the plane of the illustrated dart tool of FIG. 4.

DETAILED DESCRIPTION

Figure 6:
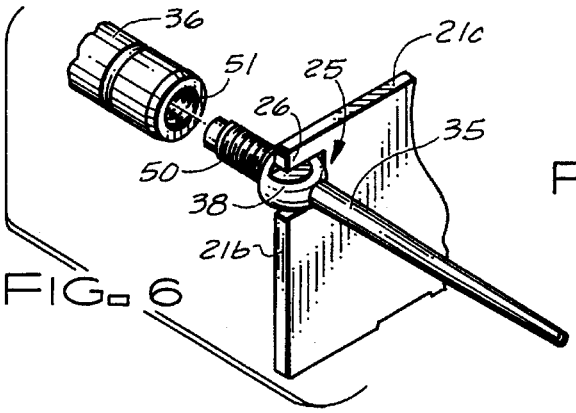
FIG. 6 is a perspective view of the dart tip and front portion of the barrel of a typical dart, illustrating the use of the preferred embodiment of the dart tool of the present invention to rotatively restrict the dart tip.

FIG. 1 shows a preferred embodiment of the dart tool 21 of the present invention and a typical dart assembly 22. Dart tool 21 includes many elements in combination. Wedge means 23 is preferably located along a first side 21*a* (being a longitudinal edge, as shown) of elongated planar handle means 24 (comprising an upper and a lower planar side, as shown in FIGS. 1–3) and adjacent a first end 21*b* (including an associated end edge, as shown) thereof, as shown. Slot means 25 is also located adjacent first end 21*b*. Planar protuberance 26 is in line with the second side 21*c* (being a second longitudinal edge, as shown) of handle means 24 and comprises a structural side-part of slot means 25, as shown. At the second end 21*d* of handle means 24, a thin nub means 27 includes an outward portion 28 situate at about 90 degrees from the plane of handle means 24. Outward portion 28 of thin nub means 27 includes tapered slot means 29 (whose taper is shown more clearly in FIG. 14). Also shown are bottle opener means 30, flight-lock-tightening hole 31, advertising indicia 32, and keychain hole 33. FIG. 1 also illustrates a typical keychain 34 for keychain hole 33.

The typical dart assembly 22 shown in FIG. 1 includes dart tip 35, dart barrel 36, and flight shaft 37. Dart tip 35 includes opposed -flat portion 38. Dart barrel 36 includes knurled portions 39 for assisting with gripping dart barrel 36. Flight shaft 37 includes flight lock 40, transverse hole 41, and knurled portion 42. As described in the above review of the prior art, in the illustrated typical dart assembly 22, both ends of dart barrel 36 contain internal threads for receiving the externally threaded ends of dart tip 35 and flight shaft 37, respectively.

As shown more clearly in FIG. 2, tapered slot means 29 also includes a transverse taper 43, narrowest on the outward side 44 of outward portion 28 and tapering to widest on the inward side 45 of outward portion 28. Also shown more clearly in FIG. 2 is the wedge recess 46 for safety protection from sharp edge 47 of wedge means 23.

FIGS. 4 and 5 show most clearly the manner in which planar protuberance 26 of dart tool 21 may serve to assist flight shaft 37 for rotative resistance by the insertion of planar protuberance 26 into transverse hole 41 of flight shaft 37. FIG. 4 illustrates typical flight 48 and its manner of attachment within flight lock 40, and also illustrates the threaded portion 49 of flight shaft 37, which threaded portion 49 is suitable for threaded connection with dart barrel 36.

Figure 7:
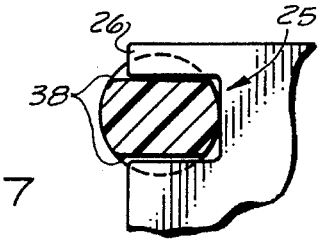
FIG. 7 is a partial sectional view through the axis of the dart tip of FIG. 4 and in the plane of the illustrated dart tool of FIG. 4.

FIGS. 6 and 7 show most clearly the manner in which slot means 25 of dart tool 21 may serve to assist dart tip 35 for rotative resistance by the holding of opposed-flat portion 38 of dart tip 35 by opposed portions of slot means 25, as shown. FIG. 6 illustrates the threaded portion 50 of dart tip 35, which threaded portion 50 is suitable for threaded connection with dart barrel 36 at its forward end 51.

Figure 9:
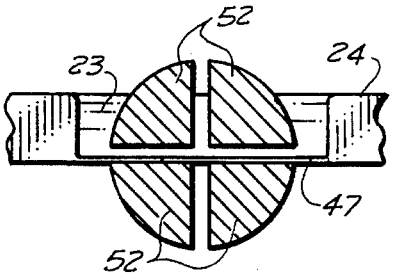
FIG. 9 is a partial front sectional view through the flight lock of FIG. 8 at the front edge of the wedge.
Figure 8:
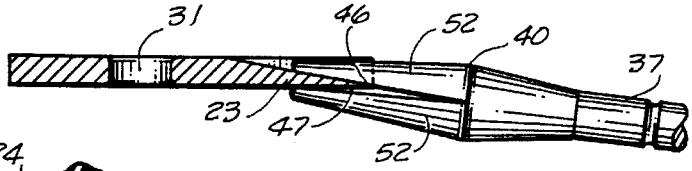
FIG. 8 is a partial side sectional view through the wedge means and the flight-lock-tightening hole of the preferred embodiment of the dart tool of the present invention, illustrating the loosening of a typical flight lock by the wedge means.

FIGS. 8 and 9 show most clearly the manner in which wedge means 23 of dart tool 21 may loosen flight lock 40 by wedging open and slightly bending (by user-applied pressure to the wedge means) opposed quadrants 52 of flight lock 40. By turning the flight lock 90 degrees, the user may then use wedge means 23 to loosen the remaining opposed quadrants 52 of flight lock 40 so that the cross-shaped flight 48 may be more easily inserted in flight lock 40. The preferred placement of wedge means 23 near the end of handle means 24 which is away from tapered slot means 29 permits use of wedge means 23 without interference from the outward portion 28 (of thin nub means 27) which is turned outward from the plane of handle means 24 at an angle of about 90 degrees. Further, the illustrated preferred placement of wedge means 23 (along a specific side of handle means 24) helps prevent accidental contact with sharp edges during other uses of the dart tool 21, e.g., during extraction of broken dart tips.

Figure 10:
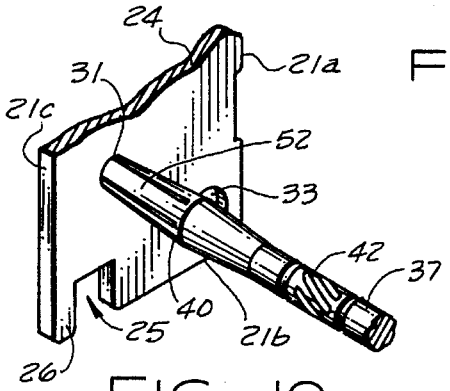
FIG. 10 is a perspective view of a rear portion of the flight shaft of a typical dart, illustrating the use of the preferred embodiment of the dart tool of the present invention to tighten the flight lock.
Figure 11:
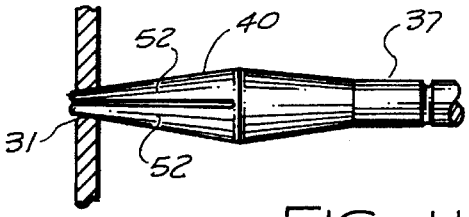
FIG. 11 is a partial sectional view along the axis of the flight-lock-tightening hole of FIG. 10 and in the plane of the illustrated dart tool of FIG. 10, illustrating the tightening of a typical flight shaft by such hole.

FIGS. 10 and 11 show most clearly the manner in which flight-lock-tightening hole 31 may tighten flight lock 40 by the user pushing the conically-tapered flight lock 40 into hole 31 to force the quadrants 52 of flight lock 40 closer together by slightly bending quadrants 52 inward so that the cross-shaped flight 40 may be more tightly held by flight lock 40.

Figure 14:
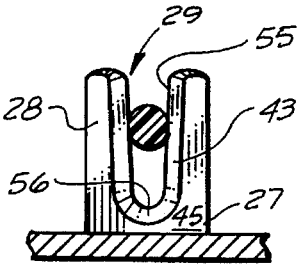
FIG. 14 is a partial sectional view of the broken dart tip and tapered slot of FIG. 12 perpendicular to the axis of the broken dart tip and looking toward the dart target of FIG. 12 along the section 14—14 of FIG. 12.
Figure 12:
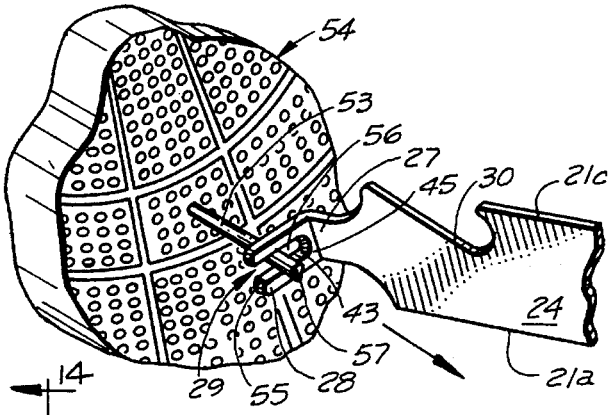
FIG. 12 is a partial perspective view of a portion of a typical dart target and illustrating the use of the dart tool of the present invention to grab and remove a broken dart tip from the dart target.
Figure 13:
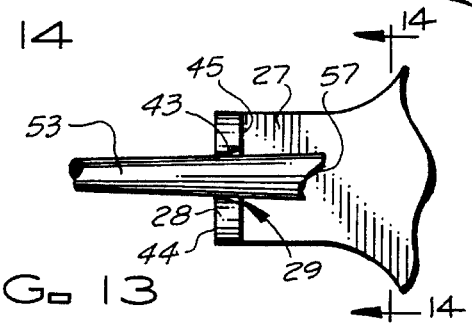
FIG. 13 is a partial sectional view along the axis of the broken dart tip of FIG. 12 from the top of the dart tool of the present invention at the tapered slot portion of the dart tool.

FIGS. 12, 13, and 14 show most clearly the manner in which the tapered slot means 29 of dart tool 21 may be used to grab and extract a broken dart tip 53 from a dart target 54. Tapered slot means 29 of dart tool 21 may be placed or pushed as close to dart target 54 as is necessary to push any extending portion of broken dart tip 53 into tapered slot means 29. As shown clearly in FIG. 14, tapered slot means 29 is wider than any portion of broken dart tip 53 at the open end 55 of tapered slot means 29 and narrower than any portion of broken dart tip 53 at the closed end 56 of tapered slot means 29; and so tapered slot means 29 may capture broken dart tip 53 as shown in FIG. 14. In addition, as shown clearly in FIG. 13, tapered slot means 29 also includes a transverse taper 43, narrowest on the outward side 44 of outward portion 28 and tapering to widest on the inward side 45 of outward portion 28, that is, tapered slot means 29 widens toward the handle-means side of outward portion 28 of nub means 27. This transverse taper 43 assists in grabbing of broken dart tip 53 while extracting it from dart target 54 in that broken dart tip 53 becomes slightly wider in diameter toward its outer (rearward) broken edge 57 and in that transverse taper 43 provides a thin "grabbing" edge to tapered slot means 29, as shown. The thinness of thin nub means 27 permits the extension including tapered slot means 29 to be of a size to best push closest to dart target 54 (which typically has some "give" to it) to grab broken dart tip 53.

FIG. 1 best illustrates how the preferred placements of the various elements of dart tool 21 combine to provide a unitary solution to the problems of the prior art. In addition, these preferred constructions and placements permit not only an efficient keychain placement but also maintain considerable flat and open areas for the location of adverising indicia 32 on either side of dart tool 21.

It is especially pointed out that the recessed nature of the wedge means 23 of the present invention prevents accidental injury to the user, and its illustrated highly-preferred location even provides for safe use of the bottle-opener means 30 as well as being able to safely grasp handle means 24 when using tapered slot means 29 to grab and extract broken dart tip 53. It is further especially pointed out that the preferred material for the dart tool 21 of the present invention is a hard metal; and that the illustrated preferred wedge construction of wedge means 23, in its having only one plane inclined to the plane of handle means 24, permits especially easy and efficient manufacturing of the preferred dart tool 21 in the area of wedge means 23 in that only one piece must be removed from flat planar material to make the wedge.

Further advantages of applicant's invention will be apparent to those skilled in the art from the above descriptions and the below claims.

What is claimed is:

1. A dart tool suitable for adjusting a dart assembly having a flight shaft, a barrel and a dart tip, comprising, in combination, a. elongated, planar handle means comprising two planar sides, two longitudinal edges, two ends, and at least one end edge; and b. recessed inwardly from a said at least one of three edges of said handle means and adjacent a first said end of said handle means said terminus comprising thin nub means, wedge means for opening a flight lock in a dart.

2. A dart tool in accordance with claim 1 including a. situate in said handle means adjacent said first end, slot means comprising opposed parallel sides; and b. in line with a said longitudinal edge of said handle means, a planar protuberance comprising a first said parallel side of said slot means.

3. A dart tool in accordance with claim 1 wherein said wedge means comprises a single plane inclined with respect to said planar sides of said handle means.

4. A dart tool in accordance with claim 3 wherein said wedge means is located along a said longitudinal edge of said handle means.

5. A dart tool in accordance with claim 1, further suitable for extracting a broken dart tip from a dart target, including a. a terminus at a second said end of said handle means;

b. an outward portion of said hub means being situate at about 90 degrees from said planar sides of said handle means said outward portion of said nub means comprising an outward side and an inward side (closer to said handle means than said outward side); and c. in said outward portion, tapered slot means, comprising a slot having an open end and an opposed closed end, for grabbing a said broken dart tip.

6. A dart tool in accordance with claim 5 wherein said wedge means comprises a single plane inclined with respect to said planar sides of said handle means.

7. A dart tool in accordance with claim 6 wherein said wedge means is located along a said longitudinal edge of said handle means.

8. A dart tool in accordance with claim 5 wherein said tapered slot means widens toward the said inward side of said outward portion of said nub means.

9. A dart tool in accordance with claim 5 wherein said slot of said tapered slot means is wider than a said broken dart tip at said open end of said slot and narrower than a said broken dart tip at said closed end of said slot.

10. A dart tool in accordance with claim 5 including a. situate in said handle means adjacent said first end, slot means comprising opposed parallel sides; and b. in line with a said longitudinal edge of said handle means, a planar protuberance comprising a first said parallel side of said slot means.

11. A dart tool in accordance with claim 10 wherein said tapered slot means widens toward said inward side of said outward portion of said nub means.

12. A dart tool in accordance with claim 11 wherein said slot of said tapered slot means is wider than a said broken dart tip at said open end of said slot and narrower than a said broken dart tip at said closed end of said slot.

13. A dart tool in accordance with claim 10 wherein said wedge means is located along a said longitudinal edge of said handle means opposed to said longitudinal edge with which said planar protuberance is in line.

14. A dart tool in accordance with claim 13 including a. in said handle means along said longitudinal edge of said handle means with which said planar protuberance is in line, bottle opener means.

15. A dart tool in accordance with claim 12 including a. in said handle means along said longitudinal edge of said handle means with which said planar protuberance is in line, bottle opener means;

b. wherein said wedge means is located along a said longitudinal edge of said handle means opposed to said longitudinal edge with which said planar protuberance is in line;

c. wherein said wedge means comprises a single plane inclined with respect to said planar sides of said handle means;

d. wherein said planar protuberance is constructed and arranged for holding said flight shaft for rotatively disconnecting from said barrel; and e. wherein said handle means is constructed and arranged for holding advertising indicia.

* * * * *

UNITED STATES PATENT AND TRADEMARK OFFICE

CERTIFICATE OF CORRECTION

PATENT NO. : 5,495,630
DATED : March 5, 1996
INVENTOR(S) : Estein et al.

It is certified that error appears in the above-indentified patent and that said Letters Patent is hereby corrected as shown below:

In Claim 1, column 6, lines 54-55 of the Patent, after "said handle means", delete "said terminus comprising thin nub means".

In Claim 5, column 7, line 3 of the Patent, after "said handle means", insert ---, said terminus comprising thin nub means---.

Signed and Sealed this

Twenty-fifth Day of June, 1996

*Attest:*

Bruce Lehman

BRUCE LEHMAN

*Attesting Officer*

*Commissioner of Patents and Trademarks*